US005388761A

United States Patent [19]

Langeman

[11] Patent Number: 5,388,761

[45] Date of Patent: Feb. 14, 1995

[54] PLURAL COMPONENT DELIVERY SYSTEM

[76] Inventor: Gary D. Langeman, R.R. #2 386, Ruthven, Ontario N0P 2G0, Canada

[21] Appl. No.: 130,233

[22] Filed: Oct. 1, 1993

[51] Int. Cl.[6] ..... B05B 7/16

[52] U.S. Cl. ..... 239/1; 239/13; 239/61; 239/112; 239/135; 239/398; 222/138; 222/146.5; 222/148; 417/44.1

[58] Field of Search ..... 239/1, 13, 61, 67–69, 239/71, 74, 112, 113, 135, 139, 398, 407, 412, 413, 417.5; 417/5, 17, 44 R; 222/57, 63, 135, 138, 145, 146.5, 148

[56] References Cited

U.S. PATENT DOCUMENTS

| | | | |
|---|---|---|---|
| 3,232,585 | 2/1966 | Garbarino, Jr. et al. . | |
| 3,921,901 | 11/1975 | Woodman | 239/61 |
| 4,019,653 | 4/1977 | Scherer et al. . | |
| 4,341,327 | 7/1982 | Zeitz | 222/135 |
| 4,493,286 | 1/1985 | Carson | 222/135 |
| 4,509,903 | 4/1985 | Fram | 222/135 |
| 4,714,545 | 12/1987 | Bente et al. | 417/5 |
| 4,789,100 | 12/1988 | Senf . | |
| 4,809,909 | 3/1989 | Kukesh | 239/61 |
| 4,928,880 | 5/1990 | Prus et al. | 239/112 |
| 4,998,672 | 3/1991 | Bordaz et al. . | |
| 5,005,765 | 4/1991 | Kistner | 239/135 |

*Primary Examiner*—Karen B. Merritt
*Attorney, Agent, or Firm*—Deeth Williams Wall

[57] ABSTRACT

An apparatus and method for mixing and delivering plural liquid components in a selected volume ratio. For each component, a separate motor drives a separate rotary gear pump that delivers the component to a common mixing and delivery device (spray gun). The speed of each motor, and correspondingly the volume of fluid delivered by that pump, is determined by a respective programmable computer. The individual computers are interlinked, with one master computer and the rest slave(s). Desired motor speeds are input into the computers in a selected ratio. A change in the speed of the master motor therefore produces a corresponding change in the speed of a slave motor according to the ratio. Actual motor speed is monitored and transmitted to the respective computer for feedback control. A simple manual ratio test is provided for calibration of the system. Each pump is magnetically coupled to its respective motor drive shaft.

28 Claims, 4 Drawing Sheets

PLURAL COMPONENT DELIVERY SYSTEM

FIELD OF THE INVENTION

This invention relates to systems for the mixing and delivery of plural liquid components in a selected volume ratio. It is particularly advantageous for components that are relatively stable when isolated from other components of the final mixture, but are reactive upon mixing.

BACKGROUND OF THE INVENTION

In the preparation of such materials as polyurethane, certain paints, varnishes, epoxies and the like from a plurality of liquid components, it is generally necessary to maintain a selected volume ratio between the components. The ratio can vary depending upon the particular application and on the chemical formulation of a given component. For example, in the case of polyurethane, the two components, isocyanate and polyol, are prepared in a variety of formulations depending upon the application. Such formulations are often intended to be combined in a 1:1 ratio. However, other mixing ratios, such as 5:1 and 1:5, are not uncommon. The appropriate mixing ratio for any particular application may also vary with environmental conditions such as temperature, which affect the reactivity, viscosity or other physical or chemical properties of the components of the mixture.

During the delivery of fluid components, the actual ratio between the components as delivered may vary from a desired, preset value, for example, as a result of a blockage in a hose. Therefore, the delivery of components needs to be monitored and occasionally corrected.

It is desirable for an operator of a plural component delivery system to be able to adjust the rate of flow of mixed material from a mixing device during operation. During and after such adjustments, the ratio between the components as they are being delivered from their respective sources to the mixing device should remain constant. It is also desirable for an operator to be able easily to adjust in very small increments the proportional output of respective pumps that deliver the liquid components, to compensate for any day to day changes that may occur in the properties of the components. It is also desirable that a plural component delivery system allow the selection of a component ratio from a wide range of values.

Accordingly, there is a need for a mixing and delivery system in which the ratios between the plurality of liquid components can be accurately set, maintained and changed.

In plural liquid component applications such as the mixing of paint colors, it may be desirable to keep the individual paint components, which do not react with each other chemically, separate from each other.

In contrast, in the creation of certain materials from plural liquid components, the components react with each other upon mixing, although they are individually relatively stable. The speed of such reaction, and consequently the formation of the resulting product, depends upon the particular chemical formulations of the components and on ambient conditions. In some cases, it can be quite rapid. An example is the spraying of a polyurethane mixture on a surface that does not allow for containment of the mixture during gelling or curing, for example, on the bed of a pick-up truck. Here, as well as in certain other types of applications, it is not convenient to apply heat to accelerate the reaction of the components. Thus, the isocyanate and polyol preparations intended for use in the spraying of polyurethane are formulated to react aggressively when mixed , together, to form the polyurethane quickly. It is necessary to keep the components isolated from each other prior to mixing. Precise and proportionate volumes of the components must be delivered to the mixing device simultaneously, maintaining a preselected ratio. For the proper reaction to take place, complete mixing of the components must occur prior to spraying. Once properly mixed, the reacting fluid material must be delivered from the mixing device at a rate fast enough that it does not gel prematurely and obstruct the flow from the device.

There are numerous types of systems designed for the mixing and delivery of plural liquid components. Some of the most common machines for the spraying of polyurethane use piston type pumps with a separate cylinder for each component of the mixture. These systems must be operated at high pressure (above approximately 1000 psi) to minimize surging line pressure during the piston strokes and to permit consistent impingement mixing in the spray gun. Changing the delivery ratio in such systems generally requires substitution of a different sized pump, which obviously cannot be done while the system is operating, and which involves significant "downtime" of the machine. Smaller adjustments may in some cases be .made using flow valves. In general, these systems are relatively expensive.

Less costly are low pressure (below approximately 1000 psi) application systems that typically use positive displacement rotary vane or rotary gear pumps. Here, one motor is often used to drive two or more gear pumps, with the relative rates of component flow being set by the gear ratio between pumps. A pre-set ratio of component volumes is thereby maintained despite any fluctuations that may occur in motor speed. If a small change in the ratio is desired, it can sometimes be accomplished using control valves in the lines between the pumps and the mixing/delivery device. However, this is generally not desirable, as it requires recalibration of the system. It is more common to change the gear ratio of the pumps, which often involves substituting pump drive gears, or even one pump for another. Consequently, low pressure systems are not commonly used when variable rate control is desired.

U.S. Pat. No. 4,809,909 describes a high pressure system for applying plural reactive liquid components. A single air-driven piston motor simultaneously drives respective piston pumps. The piston pumps may be individually adjusted to produce a desired rate of component flow.

U.S. Pat. No. 3,232,585 describes a two-component foam spray system using two motors that are directly coupled through a gear box. The relative speeds of the motors are set by choosing an appropriate gear ratio. The ratio between the motor speeds cannot be altered while the system is running. U.S. Pat. No. 4,789,100 describes a system for pumping at least two fluids in a desired ratio, in which a single common drive motor is mechanically coupled through a gear reduction system to each fluid's respective pump.

U.S. Pat. No. 4,019,653 describes a paint spray system in which the relative proportions of the components are monitored using respective flow sensors, and set using computer control of respective valves. Such flow sensors are relatively expensive. Maintenance of these components, which are downstream of the pumps, requires disassembly of the system.

U.S. Pat. No. 3,921,901 describes a system for the atomization of a liquid spray having two components. The components are delivered to an emulsifier by respective pumps, their ratio being set using respective flow sensors. The means driving the pumps is not specified.

U.S. Pat. No. 4,998,672 describes a liquid sprayer in which flow rate can be manually controlled according to the position of a trigger on the sprayer. When used with a two-component mixture, the flow of each component is driven by a respective motor, and flow rate is monitored by a respective sensor. A computer processes signals from the flow sensors and sends feedback control signals accordingly to the respective motors to maintain the flow rates in a predetermined ratio.

SUMMARY OF THE INVENTION

The present invention provides, in a first aspect, an apparatus for mixing and delivering at least two liquid components of a mixture in a selected volume ratio, including: a first tank for storing a first component; a second tank for storing a second component; a first rotary pump for pumping the first component from the first tank; a second rotary pump for pumping the second component from the second tank; first and second motors for driving the first and the second pumps, respectively; first and second speed sensing means for monitoring the speeds of the first and the second motors, respectively; first control means for controlling the speed of the first motor, the first control means being adapted to receive signals from the first speed sensing means, and being further adapted to send signals to the first motor to control the speed thereof; second control means for controlling the speed of the second motor, the second control means being adapted to receive signals from the second speed sensing means, and being further adapted to send signals to the second motor to control the speed thereof; and a delivery device for receiving the at least two components from the respective pumps and for delivering the mixture of the at least two components. The first control means is a master control means and the second control means is a slave control means. The slave control means is further adapted to control the speed of the second motor as a function of the speed of the first motor. Operating the first and second motors at the so-controlled speeds permits the first and the second pumps to deliver the first and the second components, respectively, at substantially the pre-selected volume ratio. The apparatus may be adapted to permit the relative speeds of the first and the second motors to be changed.

In a second aspect, the present invention provides an apparatus for mixing and delivering at least two liquid components of a mixture in a selected volume ratio, including: a first tank for storing a first component; a second tank for storing a second component; a first rotary pump for pumping the first component from the first tank; a second rotary pump for pumping the second component from the second tank; first and second motors for driving the first and the second pumps, respectively; first and second speed sensing means for monitoring the speeds of the first and the second motors, respectively; a first computer for controlling the speed of the first motor, the first computer being adapted to receive signals from the first speed sensing means, and being further adapted to send signals to the first motor to control the speed thereof; a second computer for controlling the speed of the second motor, the second computer being adapted to receive signals from the second speed sensing means, and being further adapted to send signals to the second motor to control the speed thereof; and a delivery device for receiving the at least two components from the respective pumps and for delivering the mixture of the at least two components. The first computer is a master computer and the second computer is a slave computer. The slave computer is adapted to be programmed to control the speed of the second motor as a function of the speed of the first motor. Operating the first and the second motors at the so-controlled speeds permits the first and the second pumps to deliver the first and the second components, respectively, at substantially the pre-selected volume ratio. The apparatus may be adapted to permit the relative speeds of the first and the second motors to be changed.

In a third aspect, the present invention provides a process for mixing and delivering at least two liquid components of a mixture in a selected volume ratio, including the following steps: storing a first component in a first tank; storing a second component in a second tank; pumping the first component from the first tank using a first rotary pump; pumping the second component from the second tank using a second rotary pump; driving the first and the second pumps with respective first and second motors; monitoring the respective speeds of the first and the second motors with respective first and second speed sensing means; controlling the speed of the first motor with first control means, the first control means being adapted to receive signals from the first speed sensing means, and being further adapted to send signals to the first motor to control the speed thereof; controlling the speed of the second motor with second control means, the second control means being adapted to receive signals from the second speed sensing means, and being further adapted to send signals to the second motor to control the speed thereof; and delivering the mixture of the at least two components from a delivery device that receives the components pumped from the pumps. The first control means is a master control means and the second control means is a slave control means. The slave control means is further adapted to control the speed of the second motor as a function of the speed of the first motor. Operating the first and the second motors at the so-controlled speeds permits the first and the second pumps to deliver the first and the second components, respectively, at substantially the pre-selected volume ratio. The process may provide that the relative speeds of the first and the second motors can be changed.

In a fourth aspect, the present invention provides a process for mixing and delivering at least two liquid components of a mixture in a selected volume ratio, including the following steps: storing a first component in a first tank; storing a second component in a second tank; pumping the first component from the first tank using a first rotary pump; pumping the second component from the second tank using a second rotary pump; driving the first and the second pumps with respective first and second motors; monitoring the respective speeds of the first and the second motors with respective first and second speed sensing means; controlling the speed of the first motor with a first computer, the first computer being adapted to receive signals from the first speed sensing means, and being further adapted to send signals to the first motor to control the speed thereof; controlling the speed of the second motor with a second computer, the second computer being adapted to receive signals from the second speed sensing means, and being further adapted to send signals to the second motor to control the speed thereof; and delivering the mixture of the at least two components from a delivery device that receives the components pumped from the pumps. The first computer is a master computer and the second computer is a slave computer. The slave computer is adapted to be programmed to control the speed of the second motor as a function of the speed of the first motor. Operating the first and the second motors at the so-controlled speeds permits the first and the second pumps to deliver the first and the second components, respectively, at substantially the pre-selected volume ratio. The process may provide that the relative speeds of the first and the second motors can be changed.

BRIEF DESCRIPTION OF THE DRAWINGS

For a better understanding of the present invention and to show more clearly how it may be carded into effect, reference will now be made by way of example to the accompanying drawings, which show an apparatus according to the preferred embodiment of the present invention and in which.

DETAILED DESCRIPTION OF THE PREFERRED EMBODIMENTS

Figure 1:
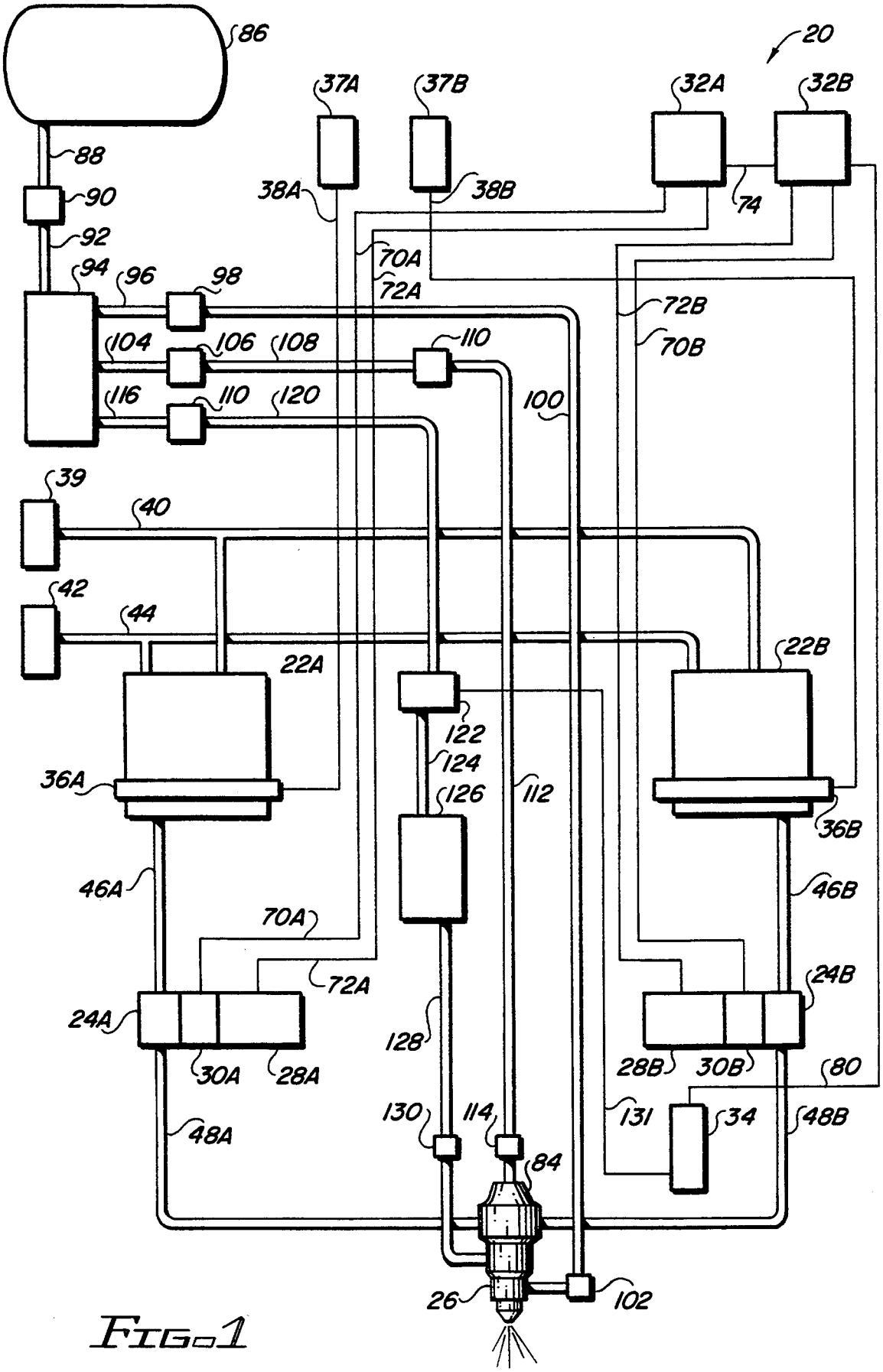
FIG. 1 is a diagrammatic illustration of a plural component delivery system according to the preferred embodiment of the present invention.
Figure 2:
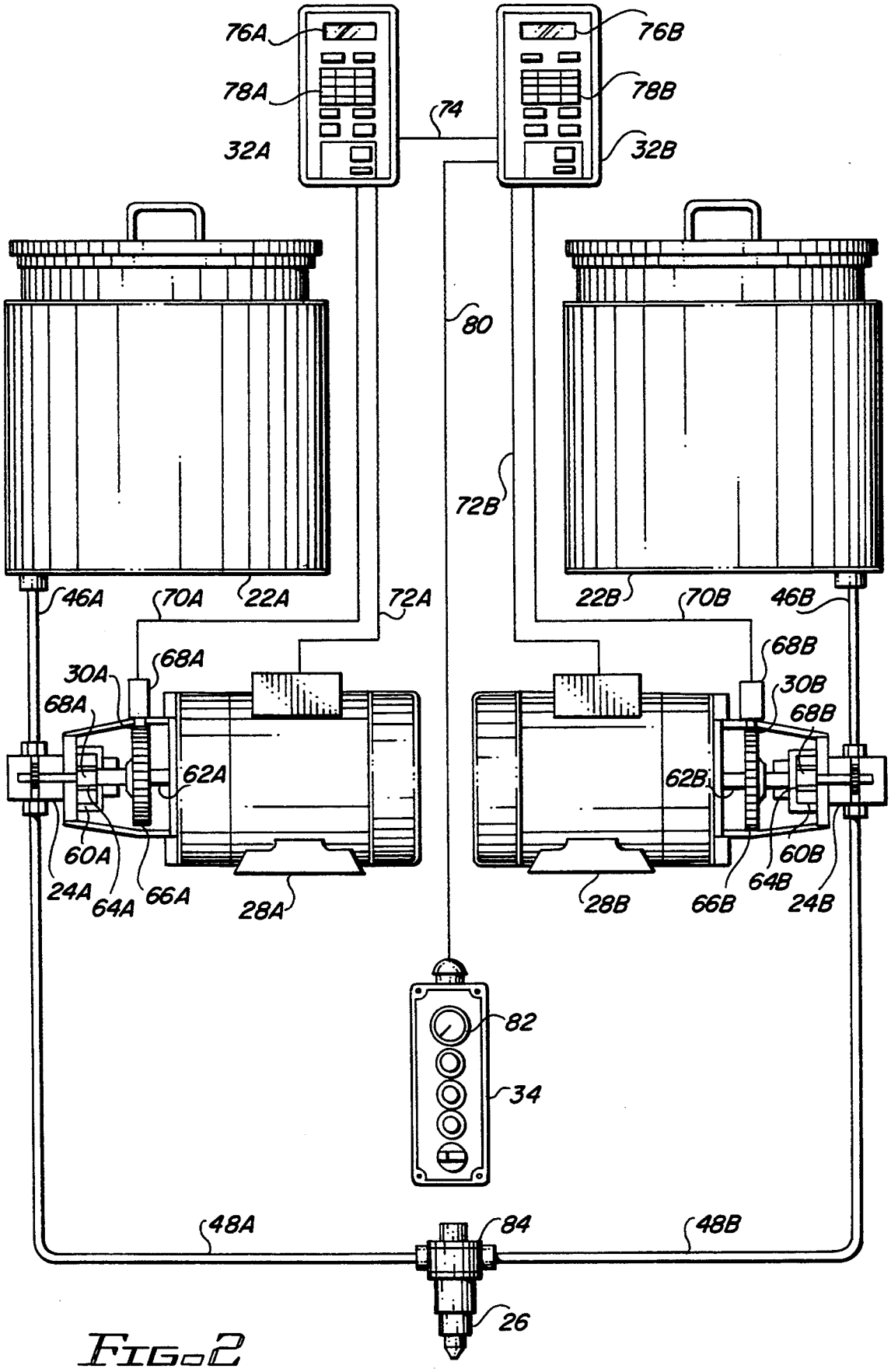
FIG. 2 is a diagrammatic illustration of a portion of the system of FIG. 1.

A plural component delivery system 20 is shown in FIG. 1, with a portion of the system expanded in FIG. 2. The system depicted is designed for the mixing and delivery of two components, A and B, in a chosen ratio. Component A is isocyanate and component B is polyol, which are combined to produce polyurethane. In other embodiments of the invention, other components may be mixed and delivered, or the system may be adapted for additional components.

Liquid component A is stored in a first tank 22A and liquid component B is stored in a second tank 22B. A respective rotary pump 24A, 24B is provided for the pumping of each component to a mixing and delivery device 26, here a spray gun. Each pump 24A, 24B is driven by a respective motor 28A, 28B. In this embodiment of the invention, the motors 28A, 28B are DC electric motors. Respective speed sensing means 30A, 30B is provided for each motor, which speed sensing means sends electrical signals to respective control means 32A, 32B. In the embodiment of the invention herein described, each control means 32A, 32B is a programmable computer 32A, 32B. Each computer 32A, 32B is electrically connected to the respective motor 28A, 28B and to each other. The computer 32B, described more fully below, is also electrically connected to a remote control device 34.

The tanks 22A and 22B are provided with respective electric heaters 36A, 36B for maintaining the components therein at desired temperature(s). Each heater 36A, 36b is electrically connected to a respective digital heater control 37A, 37B by a respective signal line 38A, 38B.

A vacuum pump 39 for removing ambient air from the tanks 22A, 22B is connected to the tanks 22A, 22B by vacuum line 40. A desiccant air dryer cartridge 42 for removing water vapor from replacement air is connected to the tanks 22A, 22B by air line 44.

The tanks 22A, 22B are connected to the pumps 24A, 24B by respective fluid suction lines 46A, 46B. The pumps 24A, 24b are in turn connected to the spray gun 26 by respective fluid delivery lines 48A, 48B.

Figure 3:
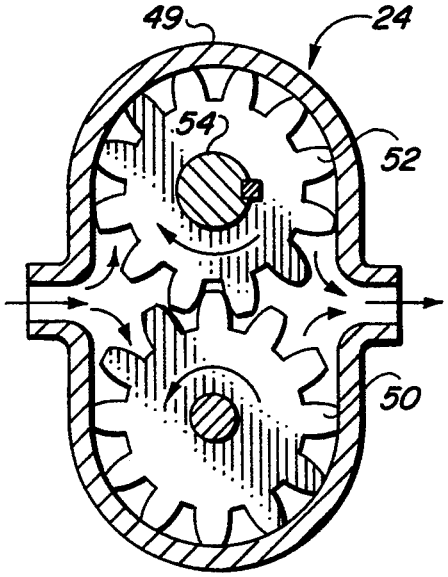
FIG. 3 is a cross-sectional plan view of a rotary gear pump of the system of FIG. 1.
Figure 4:
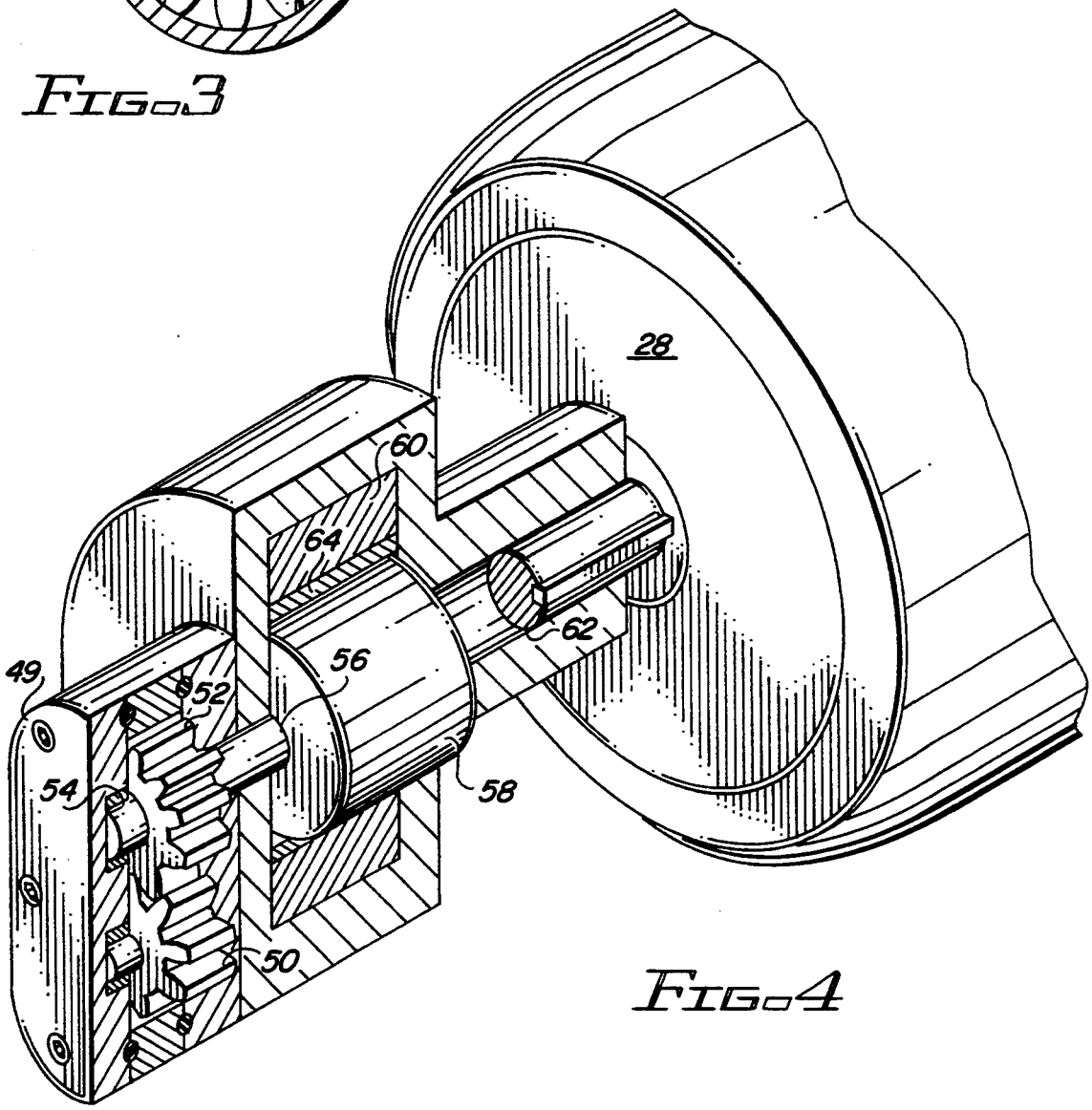
FIG. 4 is a cross-sectional perspective view of a rotary gear pump and a magnetic coupling of the system of FIG. 1.

Each pump 24A, 24B is conveniently a positive displacement rotary gear pump, as shown in FIG. 3. The pump 24A, 24B has a casing 49 that contains first gear 50 and a second gear 52. The gear 52 is attached at its center 54 to an axle 56, as shown in FIG. 4. The axle 56 is attached, at an end opposite to the gear 52, to a magnet 58 that is also contained in the pump casing 49. Exterior to the casing 49 is a second magnet 60 attached to an end of drive shaft 62 of the motor 28A, 28B. The driving magnet 60 is positioned so as to be able to form a magnetic coupling 64 between itself and the driven magnet 58.

Referring to FIG. 2, each drive shaft 62A, 62B is encircled, at a position intermediate between the motor 28A, 28B and the driving magnet 60A, 60B, by a respective sixty (60)-tooth gear 66A, 66B that is fixedly attached to the drive shaft 62A, 62B and rotates with it. A respective magnetic speed sensor 68A, 68B is positioned perpendicular to the drive shaft 62A, 62B and adjacent to the teeth of the gear 66A, 66B, so as to sense the passage of the individual teeth of the gear 66A, 66B in rotation. In this embodiment of the invention, there is a clearance between the gear 66A, 66B and the sensor 68A, 68B of about 0.005 in. Each speed sensing means 30A, 30B comprises the respective magnetic speed sensor 68A, 68B and the respective gear 66A, 66B.

The magnetic speed sensors 68A, 68B each include a magnet, not shown, that is sufficiently sensitive for a magnetic attraction to form when a single tooth of the 60-tooth gear 66A, 66B is immediately adjacent to the magnet. As the gear moth rotates away and before the next tooth is aligned with the magnet, the magnetic attraction is lost momentarily. Such magnetic pulses are converted to electrical signals that are conveyed to the computer 32A, 32B along signal lines 70A, 70B, with a pulse rate of sixty pulses per rotation of the gear 66A, 66B. The signals are processed by the computer 32A, 32B to determine motor 28A, 28B speed in rotations per minute (rpm) of the drive shaft 62A, 62B. A person skilled in the art would be able to substitute equivalent means for the 60tooth gear 66A, 66B that would allow the same calculation of motor speed.

Respective signal lines 72A, 72B are provided between the computers 32A, 32B and the motors 28A, 28B for sending feedback signals that control motor 28A, 28B speed. Signal line 74 is provided between the computers 32A, 32B for control signals as described below.

Each computer 32A, 32B has an LED display screen 76A, 76B and a numeric keypad 78A, 78B. Specific functions or programs can be utilized using the keypad 78A, 78B, with a corresponding display of a numeric value on the screen 76A, 76B. For example, actual motor 28A, 28B speed as calculated from a signal sent by the speed sensing means 30A, 30B can be displayed. Moreover, parameters can be selected, such as the ratio of speeds between the motors 28A, 28B.

The computers 32A, 32B are programmed in a master-slave relationship. In this embodiment of the invention, the computer 32B is the master and the computer 32A is the slave. In its default setting, the master computer 32B displays the actual rotation speed of the master motor 28B as a fraction or percentage of the maximum speed (rpm) of which the motor 28B is capable. This value is selected by an operator. The slave computer 32A, in its default setting, is programmed to display the fraction or percentage of the actual master motor 28B speed at which the slave motor 28A turns. That is, it displays the ratio of the two motors speeds, which value has also been selected. This ratio is generally constant during the operation of the delivery system 20; however, the slave computer 32A is preferably programmed and the delivery system 20 adapted so that the ratio may be changed during operation of the system 20, if desired.

It is significant with respect to the present invention that a positive displacement rotary pump is itself an accurate means of metering the delivery of fluid. Each rotation of the gear set of a rotary gear pump delivers a specific volume of fluid. Therefore, by monitoring the speed of the drive shaft 62 of the gear pump 24, an accurate assessment of fluid delivery can be determined. The ratio between plural components being delivered can be controlled by controlling the respective speeds of the motors 28A, 28B driving the pumps 24A, 24B. For the purpose of maintaining a selected ratio between the delivery of the respective pumps 24A, 24B, it is desirable to have an accurate speed signal substantially at all times, with feedback interaction between the individual delivery pump 24/motor 28 units.

The computers 28A, 28B are programmed to adjust the respective current flow to the motors 28A, 28B in order to maintain selected speeds, regardless of fluctuating torque requirements caused by line pressure fluctuations, etc. Conveniently, the computers 28A, 28B are digital computers having a response time of approximately 10 msec, permitting rapid adjustment of the speeds of the motors 28A and 28B, respectively.

The remote control device 34, which is electrically connected to the master computer 32B by signal line 80, is provided so that operation of the delivery system 20 can be monitored and controlled by an operator who is distant from the computers 32A, 32B. The remote control is provided with a potentiometer 82 for motor 28A, 28B speed control.

The spray gun 26 is conveniently of the dynamic mix type having a mixing chamber 84 with a motor-driven paddle, not shown, for blending the delivered components. Other suitable mixing and delivery devices, such as, for example, a pour head, are known to a person skilled in the art.

Referring again to FIG. 1, an air compressor 86 supplies compressed air for powering the spray gun 26 motor, not shown, and also for atomizing the blended components A, B being delivered from the spray gun 26. Air line 88 leads from the air compressor 86 to air filter 90, and air line 92 leads from the air filter 90 to an air dryer 94.

Air line 96 leads from the dryer 94 to an air pressure regulator 98 for controlling the pressure of the compressed air used in the atomization of blended components A and B. Atomization air line 100 leads from the air pressure regulator 98 to the spray gun 26. A ball valve 102 is positioned on the atomization air line 100 shortly before it reaches the blended components in the spray gun 26.

Air line 104 leads from the dryer 94 to an air pressure regulator 106 for controlling the pressure of the compressed air used to power the spray gun 26. Air line 108 leads from the air pressure regulator 106 to an in-line air oiler 110 for the air motor, not shown, of the spray gun 26. Air line 112 leads from the oiler 110 to the spray gun 26 motor. A ball valve 114 is positioned on the air line 112 shortly before it reaches the spray gun 26.

As depicted in FIG. 1, the air compressor 86 also supplies compressed air for flushing of the spray gun 26 with a suitable liquid solvent that can dissolve polyol and isocyanate, and release polyurethane from surfaces. Air line 116 leads from the dryer 94 to an air pressure regulator 118. Air line 120 leads, in turn, from the air pressure regulator 118 to solenoid valve 122. Air line 124 leads from the solenoid valve 122 to solvent pressure tank 126. Solvent fluid line 128 leads from the solvent tank 126 to the spray gun 26. A ball valve 130 is positioned on the fluid fine 128 shortly before it reaches the spray gun 26. Alternatively, the ball valve 130 and/or the ball valves 102, 114 may be internal to the spray gun 26. The solenoid valve 122 is connected to the remote control device 34 by signal fine 131.

Figure 5:
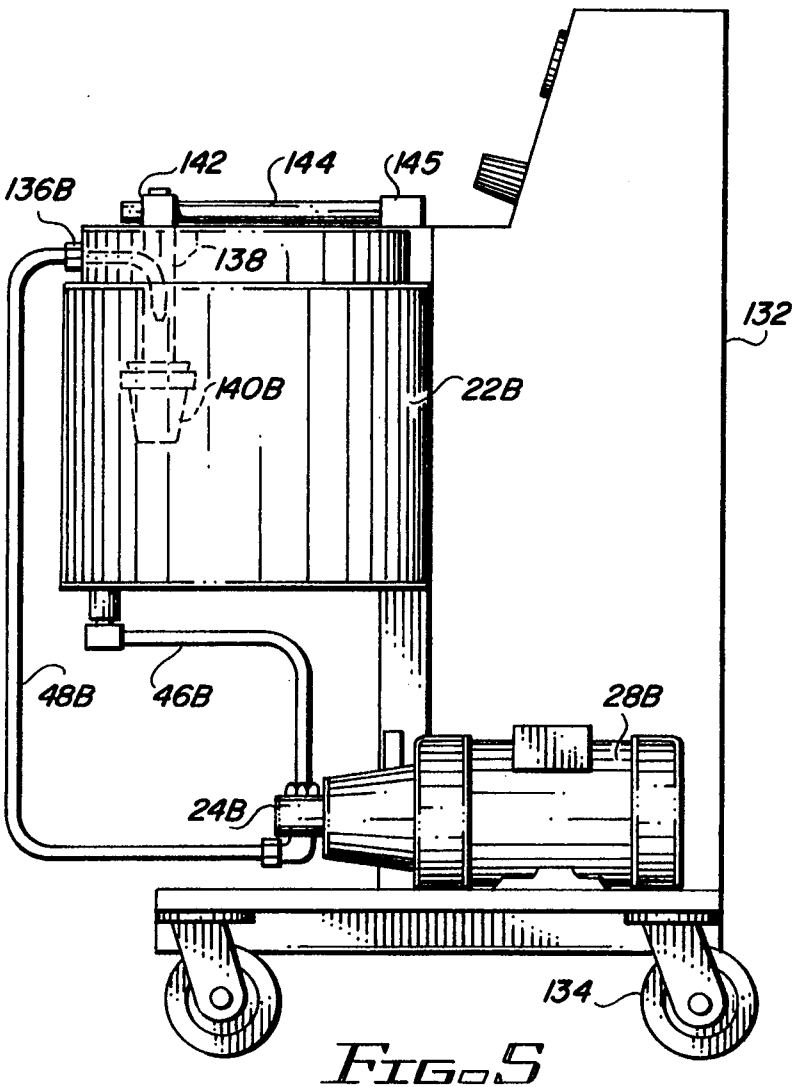
FIG. 5 is a side elevational view of a portion of a plural component delivery system according to the present invention.
Figure 6:
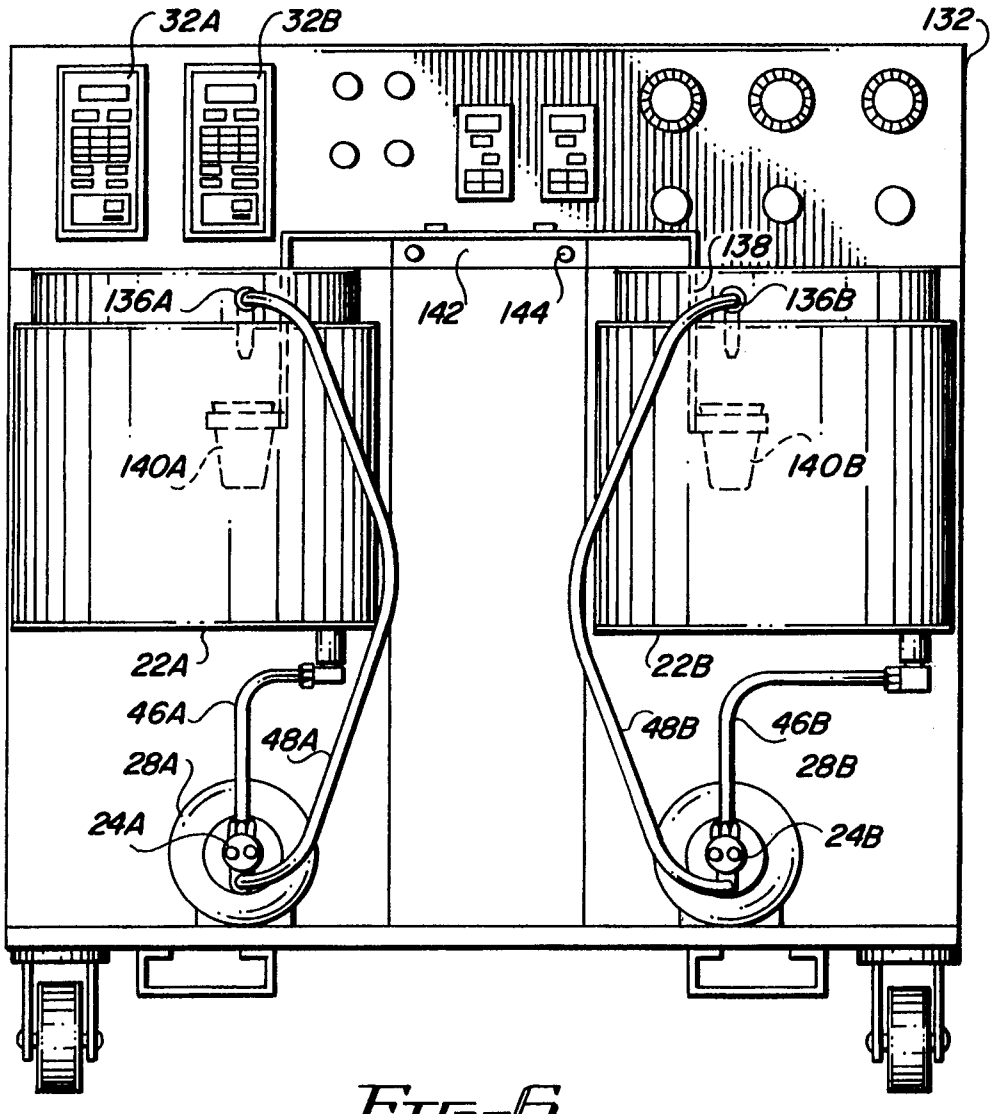
FIG. 6 is a side elevational view of a portion of the systems of FIGS. 1 and 5, the view being from a position rotated 90° from that of FIG. 5.

FIGS. 5 and 6 show diagrammatically the delivery system 20 mounted in a cabinet 132. FIG. 5 shows that the cabinet 132 may conveniently be mounted on wheels 134, pneumatic tires or the like, so that the system 20 can be easily moved to a site where spray application of the plural component mixture, here polyurethane, is desired.

FIGS. 5 and 6 also show the delivery system 20 in a temporary manual ratio test mode that utilizes the following structure: A plural cup holder arm 138 is adapted to hold two disposable cups 140A, 140B, one at each of its two ends. The plural cup holder arm 138 is temporarily attached to an aluminum slide beam 142. The slide beam 142 is slideably positioned over two parallel slide shafts 144 that are perpendicular to the slide beam 142 and project through openings in it. An end of each shaft 144 is affixed to a bushing 145 that is attached to the cabinet 132. The fluid delivery lines 48A, 48B, which would ordinarily be connected to the spray gun 26, are rerouted to respective fittings 136A, 136B on ports to the tanks 22A, 22B.

When the plural cup holder 138 is mounted to the slide beam 142, each cup 138A, 138B is positioned inside the respective tank 22A, 22B. In a first position, the cups 138A, 138B are respectively near the ends of the delivery lines 48A, 48B. In a second position, the cups 138A, 138B are located so as to receive components A and B, respectively, from the delivery lines 48A, 48B. Alternation between the two positions is attained by movement of the slide beam 142 on the slide shafts 144, which causes the plural cup holder arm 138 to move correspondingly.

For operation of the system 20, a desired ratio of the speeds of the motors 28A, 28B is first input into the computers 32A, 32B. As an example, let the master motor 28B have a maximum speed of 1800 rpm. The master computer 32B is set to run at 50.0, that is, 50.0 % of maximum speed, and accordingly the motor 28B maintains a speed of 900 rpm. The slave computer 32A is also set at 50.0, that is, 50.0% of the master motor 28B speed. The slave motor 28A accordingly maintains a speed of 450 rpm. Because the computers 32A, 32B are programmed in a master-slave association, when the speed setting of master motor 28B is changed on the master computer 32B, the slave computer 32A automatically maintains the pre-selected ratio and changes the speed of the slave motor 28A proportionately. The ratio of the motor speeds, or the percentage of the master motor 28B speed at which the slave motor 28A runs, can also be changed.

Input may be entered using the computer keypads 78A, 78B or the remote control device 34. In one embodiment of the present invention, the speed potentiometer 82 of the remote control device 34 provides the only means of adjusting the speed of the master motor 28B. The shaft, not shown, of the potentiometer 82 is attached to a rotary dial, which is depicted in FIG. 2 as having speed gradations encircling it. The dial can be rotated manually to override the keypad 78B speed setting function of the master computer 32B. In another embodiment of the invention, master motor 28B speed can be changed at the keypad 78B.

The motors 28A, 28B drive the pumps 24A, 24B to deliver components A and B to the mixing chamber 84 of the spray gun 26. Compressed air from the air line 112 powers the gun 26 motor for the mixing of the components in the mixing chamber 84. Compressed air from the atomization air line 100 disperses the reactive mixture onto a surface in a uniform spray pattern. Throughout the start, duration and completion of spraying, the computers 32A, 32B control the speed of their respective pump 24/motor 28 units, to maintain the component ratio.

Conveniently, the remote control device 34 is adapted for switching the motors 28A, 28B on and off. The spray gun 26 does not have a triggering device. Thus, the remote control device 34 is used for starting and stopping flow of the components A and B to the spray gun 26, and of the mixture from the spray gun 26. In certain other embodiments of the invention, the spray gun 26 may be provided with a trigger.

Solvent flushing is provided to remove all of components A and B from the mixing chamber 84 of the spray gun 26 when spraying is finished and before the components can react and solidify inside the gun 26. A switch, not shown, on the remote control device 34 is activated, sending an electrical signal along line 131 to close the electrical circuit of the solenoid valve 122. This allows compressed air from the air line 120 to pass through the solenoid valve 122 and the air line 124, and to fill the pressure tank 126. This, in turn, forces the solvent in the tank 126 to flow to the mixing chamber 84 of the spray gun 26 via fluid line 128. The ball valve 130, which is normally closed, is opened manually by an operator to flush the mixing chamber 84 and exhaust the waste fluid.

During filling of the tanks 22A, 22B, mixing of any additives in components A or B, the ratio test or any other time that the tank 22A, 22B lids are off, ambient air containing water vapor can enter the tanks 22A, 22B. Water in components A or B, here isocyanate and polyol, inhibits their reactivity and alters the characteristics of the final product. Thus, at such time that the tanks 22A, 22B are closed and sealed, the vacuum pump 39 removes from them all of the ambient air that has entered. The evacuation causes replacement air to be drawn through the desiccant cartridge 42 and the air line 44, and into the tanks 22A, 22B. During pumping of the components A and B from the tanks 22A, 22B, dry air is drawn into them in this manner to replace the fluid. Without this arrangement, the tanks 22A, 22B would have to be open during pumping.

Calibration of the pumping units 24/28 is provided by a simple manual ratio test, using the apparatus described above and depicted in FIGS. 5 and 6. The respective outputs of the pumps 24A, 24B during the same discrete time period are measured, and the actual ratio of the components A and B is determined. Consequently, any corrections may be entered into the computers 32A, 32B to arrive at the desired ratio of the components. The ratio test is performed while the pumps 24A, 24B are operating at speeds similar to those required for the spray operation.

During the ratio test, the slide beam 142 is manually moved along the two slide shafts 144, so that the cup holder arm 138 moves from the first position, in which the cups 140A, 140B are near the delivery lines 48A, 48B, to the second position, in which the cups 140A, 140B simultaneously receive fluid from the delivery lines 48A, 48B. The parallel slide shafts 144 maintain accurate alignment of the beam 142 and the cup holder arm 138 throughout their entire path of travel. When a sufficient sample of material has been deposited in the cups 140A, 140B, the slide beam 142 is pushed back to the first position, out of the path of flow. The cups 140A, 140B are then removed from the cup holder arm 138 and individually weighed on a precision scale to determine the actual volume of material that the pumps 24A, 24B simultaneously delivered. A calculation is made of any adjustment to motor speed needed to have the correct proportion of components A and B flow from their respective pumps 24A, 24B. The speed of the slave motor 28A is then increased or decreased accordingly.

Modifications to the embodiment of the present invention described above would be apparent to a person skilled in the art. For example, another type of positive displacement rotary pump, such as a rotary vane pump, a screw type pump or a rotary piston pump, might be substituted for the gear pump 24. Such a pump must consistently deliver a specific volume with each rotation, as described above, so that pump output is directly proportional to the number of rotations of the drive shaft 62.

In some embodiments of the invention, the control means 32A, 32B may not be a computer, but an integrated circuit or other processing unit, as is known to a person skilled in the art.

In some embodiments of the invention, it may be desirable to calibrate the pumping units 24/28 using flow sensors, rather than or in addition to the manual ratio test.

The present invention provides a simple, reliable, low maintenance and cost effective apparatus and method for the mixing and delivery of a plurality of liquid components, which components may in certain cases be reactive. By using computer technology and rotary pump design, the invention achieves results that previously required more costly systems having more components. The skill required of an operator is also reduced, as well as the possibility of error.

The degree of control of the present system is superior to previous systems. Using programmable computers 32A, 32B, the precise speeds of the motors 28A, 28B and, thus, the outputs of the pumps 24A, 24B are finely controlled. An operator has rapid, push-button control over the driven speed of the pumps 24A, 24B. In the preferred embodiment, this ranges from very minute increments of adjustment of less than one percent to adjustments exceeding five hundred percent.

A wide size range of pumps can be used with the control system of the present invention, which allows for the interchange of individual pumps, even when a different component is to be pumped. In contrast, previous systems required that the individual pumps be assembled differently from each other in order to achieve a desired ratio. The present invention eliminates the need for mechanical adjustments to the pumps 24A, 24B to achieve a desired volume ratio.

During operation, the master-slave relationship between the respective pump 24/motor 28 units ensures the maintenance of a chosen component ratio. For example, if a power surge causes the speed of the master motor to fluctuate, the speed of the slave motor will automatically change with it, maintaining the component ratio.

It is advantageous to control pump 24 output by monitoring and controlling the speed of the motor 28 driving it, rather than to monitor output using a flow sensing device downstream of the pump 24. Not only is a flow meter one more possible source of error; but it also involves a greater lag time between the detection of a condition requiring pump/motor speed adjustment and the adjustment being made than does speed sensing means 30 of the present invention. The preferred computers 32A, 32B described above have a 10 msec response time that permits rapid adjustment of the respective speeds of the individual pumping units 24/28. Using the system of the present invention, the possibility that the individual fluid components will be delivered to the mixing device at a ratio other than that pre-set by an operator is extremely remote.

The feature of driving the pumps 24A, 24B using the magnetic coupling 64 provides at least two advantages. First, the pump 24 is completely sealed, with no drive shaft entering it from the motor 28. This protects the components A and B from risk of exposure to air that might enter the pump 24 from a deteriorated shaft seal or gland. Such isolation is desirable, as, for example, exposure of the components of polyurethane to air alters the physical properties of the finished product.

A second advantage of the magnetic drive is the creation of a simple pressure relief system that can rapidly disengage the pump 24 from the drive motor 28. If blockage or another condition of the delivery line 48 produces additional torque such that the driven magnet 58 cannot follow the driving magnet 60, the magnets 58, 60 will uncouple and pumping will stop. Thus, the risk of rupturing the tubing or hose of line 48 by continued pumping is reduced. The strengths of the magnets 58, 60 (and, accordingly, the strength of the coupling 64) are chosen based on the pressure rating (safety limit) of the line 48. Other plural component delivery systems commonly use relief valves of various design which redirect liquid flow when pressure exceeds a pre-set limit. When integral relief valves are used, the complexity of the pumps is increased. When the valves are not integral to the pumps, they are additional system components that must be maintained and inspected.

The simple manual ratio test apparatus of the present invention is less costly than flow sensors and requires minimal maintenance. Human error is minimized by using a mechanical device to slide the cups 140 in and out of the flow of material simultaneously. An operator needs only basic instruction to fully understand the procedure and perform it correctly. The test is also extremely accurate, as samples are weighed on a precision scale. This is superior to visual inspection in a calibrated container, as provided by some prior art systems, which has greater risk of operator error.

This description is made with reference to the preferred embodiment of the invention. However, it is possible to make other embodiments that employ the principles of the invention and that fall within its spirit and scope as defined by the following claims.

What is claimed is:

1. An apparatus for mixing and delivering at least two liquid components of a mixture in a selected volume ratio, comprising, a first tank for storing a first component;

a second tank for storing a second component;

a first rotary pump for pumping the first component from the first tank;

a second rotary pump for pumping the second component from the second tank first and second motors for driving the first and the second pumps, respectively;

first and second speed sensing means for monitoring the speeds of the first and the second motors, respectively;

first control means for controlling the speed of the first motor, the first control means being adapted to receive signals from the first speed sensing means, and being further adapted to send signals to the first motor to control the speed thereof;

second control means for controlling the speed of the second motor, the second control means being adapted to receive signals from the second speed sensing means, and being further adapted to send signals to the second motor to control the speed thereof; and a delivery device for receiving the at least two components from the respective pumps and for delivering the mixture of the at least two components;

wherein the first control means is a master control means, and the second control means is a slave control means, such that the slave control means is further adapted to control the speed of the second motor as a function of the speed of the first motor;

and wherein operating the first and second motors at the so-controlled speeds permits the first and the second pumps to deliver the first and the second components, respectively, at substantially the preselected volume ratio.

2. The apparatus of claim 1, wherein the apparatus is adapted to permit the relative speeds of the first and the second motors to be changed.

3. An apparatus for mixing and delivering at least two liquid components of a mixture in a selected volume ratio, comprising, a first tank for storing a first component;

a second tank for storing a second component;

a first rotary pump for pumping the first component from the first tank;

a second rotary pump for pumping the second component from the second tank;

first and second motors for driving the first and the second pumps, respectively;

first and second speed sensing means for monitoring the speeds of the first and the second motors, respectively;

a first computer for controlling the speed of the first motor, the first computer being adapted to receive signals from the first speed sensing means, and being further adapted to send signals to the first motor to control the speed thereof;

a second computer for controlling the speed of the second motor, the second computer being adapted to receive signals from the second speed sensing means, and being further adapted to send signals to the second motor to control the speed thereof; and a delivery device for receiving the at least two components from the respective pumps and for delivering the mixture of the at least two components;

wherein the first computer is a master computer, and the second computer is a slave computer, such that the slave computer is adapted to be programmed to control the speed of the second motor as a function of the speed of the first motor;

and wherein operating the first and the second motors at the so-controlled speeds permits the first and the second pumps to deliver the first and the second components, respectively, at substantially the pre-selected volume ratio.

4. The apparatus of claim 3, wherein the apparatus is adapted to permit the relative speeds of the first and the second motors to be changed.

5. The apparatus of claim 4, wherein each motor includes a rotatable drive shaft that is coupled to the respective pump that said motor drives.

6. The apparatus of claim 5, wherein each speed sensing means comprises a magnet and a toothed gear affixed to the drive shaft of the respective motor monitored by the speed sensing means to rotate therewith, the magnet and the toothed gear being arranged such that a magnetic attraction is temporarily formed between the magnet and a tooth of the gear as the gear rotates with the drive shaft, each tooth of the gear forming said attraction with the magnet;

wherein each temporary magnetic attraction creates a signal that is sent to the respective computer; and wherein the said computer is adapted to calculate the speed of the respective motor from said signals.

7. The apparatus of claim 5, wherein each drive shaft is coupled to the respective pump by a respective magnetic coupling.

8. The apparatus of claim 7, wherein each magnetic coupling includes a first driving magnet that is affixed to the respective drive shaft to rotate therewith and a second driven magnet that is internal to the respective pump and affixed to pump-driving means;

wherein the coupling is adapted such that rotation of the driving magnet can cause the driven magnet to rotate therewith to drive the pump-driving means.

9. The apparatus of claim 4, further comprising a manual ratio test apparatus the ratio test apparatus including cup means adapted to receive, individually and simultaneously during a selected period of time, respective output from each pump;

wherein each individual output so received is measured and the ratio of the respective pump outputs during the selected period of time is calculated therefrom.

10. The apparatus of claim 4, wherein the delivery device is a spray gun.

11. The apparatus of claim 10, wherein the spray gun includes a mixing chamber.

12. The apparatus of claim 4, further comprising a heater for maintaining a liquid component at a desired temperature.

13. The apparatus of claim 4, further comprising a remote control device for controlling the speed of the first motor.

14. The apparatus of claim 13, wherein the remote control device is adapted to override the first computer and to control the speed of the first motor.

15. A process for mixing and delivering at least two liquid components of a mixture in a selected volume ratio, comprising the steps of, storing a first component in a first tank;

storing a second component in a second tank;

pumping the first component from the first tank using a first rotary pump;

pumping the second component from the second tank using a second rotary pump;

driving the first and the second pumps with respective first and second motors;

monitoring the respective speeds of the first and the second motors with respective first and second speed sensing means;

controlling the speed of the first motor with first control means, the first control means being adapted to receive signals from the first speed sensing means, and being further adapted to send signals to the first motor to control the speed thereof;

controlling the speed of the second motor with second control means, the second control means being adapted to receive signals from the second speed sensing means, and being further adapted to send signals to the second motor to control the speed thereof; and delivering the mixture of the at least two components from a delivery device that receives the components pumped from the pumps;

wherein the first control means is a master control means, and the second control means is a slave control means, such that the slave control means is further adapted to control the speed of the second motor as a function of the speed of the first motor;

and wherein operating the first and the second motors at the so-controlled speeds permits the first and the second pumps to deliver the first and the second components, respectively, at substantially the pre-selected volume ratio.

16. The process of claim 15, wherein the relative speeds of the first and the second motors can be changed.

17. A process for mixing and delivering at least two liquid components of a mixture in a selected volume ratio, comprising the steps of, storing a first component in a first tank;

storing a second component in a second tank;

pumping the first component from the first tank using a first rotary pump;

pumping the second component from the second tank using a second rotary pump;

driving the first and the second pumps with respective first and second motors;

monitoring the respective speeds of the first and the second motors with respective first and second speed sensing means;

controlling the speed of the first motor with a first computer, the first computer being adapted to receive signals from the first speed sensing means, and being further adapted to send signals to the first motor to control the speed thereof; controlling the speed of the second motor with a second computer, the second computer being adapted to receive signals from the second speed sensing means, and being further adapted to send signals to the second motor to control the speed thereof; and delivering the mixture of the at least two components from a delivery device that receives the components pumped from the pumps;

wherein the first computer is a master computer, and the second computer is a slave computer, such that the slave computer is adapted to be programmed to control the speed of the second motor as a function of the speed of the first motor;

and wherein operating the first and the second motors at the so-controlled speeds permits the first and the second pumps to deliver the first and the second components, respectively, at substantially the pre-selected volume ratio.

18. The process of claim 17, wherein the relative speeds of the first and the second motors can be changed.

19. The process of claim 18, wherein the driving step includes driving each pump with a respective rotatable drive shaft of the respective motor.

20. The process of claim 19, wherein each speed sensing means comprises a magnet and a toothed gear affixed to the drive shaft of the respective motor monitored by the speed sensing means to rotate therewith, the magnet and the toothed gear being arranged such that a magnetic attraction is temporarily formed between the magnet and a tooth of the gear as the gear rotates with the drive shaft, each tooth of the gear forming said attraction with the magnet;

the process including, each temporary magnetic attraction creating a signal that is sent to the respective computer; and the said computer calculating the speed of the respective motor from said signals.

21. The process of claim 19, wherein each drive shaft is coupled to the respective pump by a respective magnetic coupling.

22. The process of claim 21, wherein each magnetic coupling includes a first driving magnet that is affixed to the respective drive shaft to rotate therewith and a second driven magnet that is internal to the respective pump and affixed to pump-driving means, wherein the coupling is adapted such that rotation of the driving magnet can cause the driven magnet to rotate therewith to drive the pump-driving means.

23. The process of claim 18, further comprising the steps of, determining the simultaneous, individual outputs of the respective pumps during a selected period of time using a manual ratio test apparatus, the ratio test apparatus including cup means adapted to receive said outputs;

measuring the so-received outputs individually; and calculating the ratio of the respective pump outputs during the selected period of time from said measurements.

24. The process of claim 18, wherein the delivery device is a spray gun.

25. The process of claim 24, wherein the spray gun includes a mixing chamber.

26. The process of claim 18, further comprising the step of maintaining a liquid component at a desired temperature with a heater.

27. The process of claim 18, further comprising the speed of the first motor with a remote control device.

28. The apparatus of claim 27, wherein the remote control device is adapted to override the first computer and to control the speed of the first motor.

* * * * *